US006789646B2

(12) United States Patent
Wang et al.

(10) Patent No.: US 6,789,646 B2
(45) Date of Patent: Sep. 14, 2004

(54) TUNABLE SOUND ABSORBING AND AIR FILTERING ATTENUATING DEVICE

(75) Inventors: Shuo Wang, Dearborn, MI (US); Gordon Ebbitt, Ann Arbor, MI (US); Mark W. Fero, Clinton Township, MI (US); Roland Woodcock, Bloomfield Hills, MI (US); Brian A. Cristea, Royal Oak, MI (US); Paul G. Deacon, Salino, MI (US)

(73) Assignee: Lear Corporation, Southfield, MI (US)

( * ) Notice: Subject to any disclaimer, the term of this patent is extended or adjusted under 35 U.S.C. 154(b) by 25 days.

(21) Appl. No.: 10/269,597

(22) Filed: Oct. 11, 2002

(65) Prior Publication Data

US 2004/0069564 A1 Apr. 15, 2004

(51) Int. Cl.[7] ..... E04B 1/82

(52) U.S. Cl. ..... 181/293; 181/294; 181/295; 428/158

(58) Field of Search ..... 181/293, 294, 181/295, 28.21; 428/138

(56) References Cited

U.S. PATENT DOCUMENTS

| | | | | | |
|---|---|---|---|---|---|
| 3,948,346 | A | * | 4/1976 | Schindler | 181/286 |
| 4,263,356 | A | * | 4/1981 | Nomura et al. | 428/138 |
| 4,298,090 | A | * | 11/1981 | Chapman | 181/286 |
| 4,504,346 | A | * | 3/1985 | Newsam | 156/242 |
| 6,033,756 | A | * | 3/2000 | Handscomb | 428/138 |
| 6,267,838 | B1 | * | 7/2001 | Saugnac et al. | 156/320 |
| 6,595,321 | B1 | * | 7/2003 | Tompson | 181/290 |

* cited by examiner

*Primary Examiner*—Shih-Yung Hsieh
(74) *Attorney, Agent, or Firm*—Bill C. Panagos

(57) ABSTRACT

Acoustical attenuating devices (52) and method of forming them. The attenuating devices (52) include an exterior layer (64), a sound absorption layer (66), and multiple perforated layers (68) coupled to the sound absorption layer (66). The perforated layers (68) include a perforated structural layer (70) and a perforated substrate layer (72). The perforated structural layer (70) and the perforated substrate layer (72) provide structural stiffness and define multiple resonating tubes (88) that attenuate sound.

20 Claims, 3 Drawing Sheets

TUNABLE SOUND ABSORBING AND AIR FILTERING ATTENUATING DEVICE

TECHNICAL FIELD

The present invention relates generally to sound absorbing systems, and more particularly, to an acoustical attenuation system for a vehicle and a method of manufacturing the same.

BACKGROUND OF THE INVENTION

Various sound absorbing materials are used throughout a vehicle in order to reduce noise levels within the vehicle cabin. It is desirable for vehicle occupants to experience low noise levels while in the vehicle, especially within a frequency range of approximately 1 KHz and 5 KHz, for which occupants are generally most sensitive.

Sound energy within a vehicle typically consists of both high and low frequency components that propagate through air and can be absorbed and attenuated through many systems or mechanisms. Several materials absorb and attenuate sound through viscous losses, movement or shearing of air in a material, or by sound induced kinetic energy losses within fibers of a material, where sound energy is converted into thermal energy. Materials may experience both viscous and kinetic losses.

Porosity and structural geometry of a material also affect airflow characteristics and resulting sound absorption and attenuation characteristics. The less porous an object, generally the less airflow through the object and the higher the airflow resistance of the object.

Vehicle headliners commonly include various types of sound absorbing and attenuating materials. Headliners are a major contributor in sound absorption and attenuation within a vehicle cabin, second only to vehicle seating systems.

Headliners can be formed of various materials and are designed for ease of manufacturing, weight consideration, durability and economics, as well as sound absorption and attenuation. Current headliners today, have several of the above desired aspects, but provide a limited amount of sound absorption and attenuation due to material properties and overall design.

It would therefore be desirable to provide a vehicle headliner with increased sound absorption and attenuation ability over current headliners while at the same time having other headliner desirable aspects such as being light in weight, relatively easy and inexpensive to manufacture, and durable.

SUMMARY OF THE INVENTION

The present invention provides an improved acoustical attenuating system for vehicles, as well as a method of producing them. The attenuating systems include an exterior layer, a sound absorption layer, and multiple perforated layers coupled to the sound absorption layer. The perforated layers include a perforated structural and a perforated substrate layers. The perforated structural layer and the perforated substrate layer provide structural stiffness and define multiple resonating tubes that attenuate sound.

The present invention has several advantages over existing acoustical attenuating devices. One advantage of the present invention is that it provides an acoustical attenuating device, such as a headliner, having multiple layers that are permeable. By controlling permeability, airflow through the attenuating device can be refined, thus providing improved sound absorption.

Another advantage of the present invention is that it has multiple perforated layers defining multiple resonating tubes, which can provide sound absorption at desired frequencies.

Furthermore, the present invention provides an air filter layer for preventing contaminates such as dust and dirt from flowing through the attenuating device.

Moreover, the present invention is versatile in that it is tunable for various frequency ranges. Thus, allowing it to be used in various acoustical attenuating applications.

Other advantages and features of the present invention will become apparent when viewed in light of the detailed description of the preferred embodiment when taken in conjunction with the attached drawings and appended claims.

DETAILED DESCRIPTION OF THE PREFERRED EMBODIMENT

Figure 1:
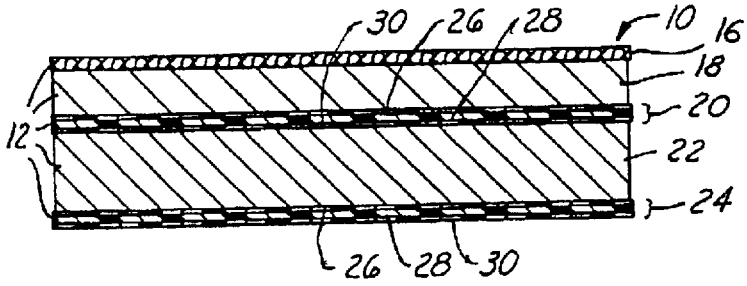
(Prior Art) FIG. 1
FIG. 1 is a cross-sectional side view of a first known headliner.

Referring now to prior art FIG. 1, a cross-sectional side view of a first traditional headliner 10, is shown. The first headliner 10 includes five main layers 12: an exterior fabric layer 16, which is visible from an interior of a vehicle, a sound absorbing foam layer 18, a first structural layer 20, a substrate foam layer 22, and a second structural layer 24. The headliner 10 is relatively easy to manufacture, is lightweight, and is durable. The sound absorbing foam layer 18 is typically made from softer material for tactile comfort. The structural layers 20 and 24 provide structural stiffness to maintain the shape of the headliner. The structural layers 20 and 24 typically include a first film layer 26, a fiberglass layer 28, and a second film layer 30. The substrate foam layer 22 is typically formed of closed cell relatively stiff foam and used for additional sound absorption and attenuation and for dimensional stability.

Figure 2:
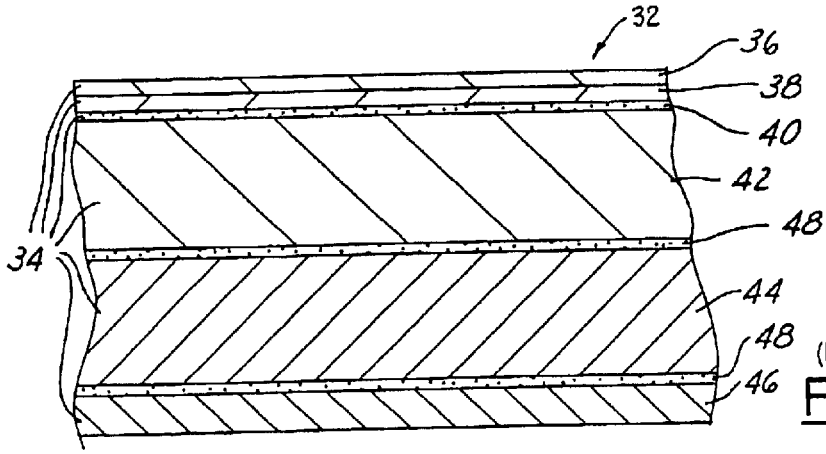
(Prior Art) FIG. 2
FIG. 2 is a cross-sectional side view of a second known headliner.

Referring now to prior art FIG. 2, a cross-sectional side view of a second traditional headliner 32 is shown. The second headliner 32 includes six main layers 34 and is further described in detail in U.S. Pat. No. 5,536,556, entitled "Insulating Laminate". The second headliner 32 is not as common as the first head liner 10 in that the second headliner 32 is more time consuming and costly to manufacture and only provides relatively similar sound absorbing and acoustical attenuation performance. The second headliner 32 includes an exterior fabric layer 36, a thin open cell foam layer 38, a thin flexible polyethylene film layer 40, a fiber mat layer 42, a foam lamina layer 44, and a scrim support layer 46. As stated in U.S. Pat. No. 5,536,556, the film layer 40 is preferably between 1–3 mm in thickness, has multiple holes and is used to increase sound attenuation. The fiber mat layer 42 is also used for sound absorption, is dense, and is saturated with resin, thus having low porosity and being largely impermeable. The scrim support layer 46 is also a fiber mat that is used for structural support. The second headliner 32 also includes several solid continuous adhesive layers 48, which secure the layers together, but further decrease overall permeability of the headliner.

Although the above-stated prior art headliners 10 and 32, as well as other headliners known in the art provide a level of sound absorption and attenuation, they are limited due to material properties, impermeability of several layers, and overall design. An increased amount of sound absorption and attenuation is desired and is provided by the present invention.

In each of the following figures, the same reference numerals are used to refer to the same components. While the present invention is described with respect to acoustical attenuation devices and systems for vehicle headliners and methods of manufacturing them, the present invention may be adapted to be used in various other vehicles and applications such as aeronautical vehicles, watercraft, other vehicle panels, or any other applications where acoustical attenuation is needed.

In the following description, various operating parameters and components are described for one constructed embodiment. These specific parameters and components are included as examples and are not meant to be limiting.

Figure 3:
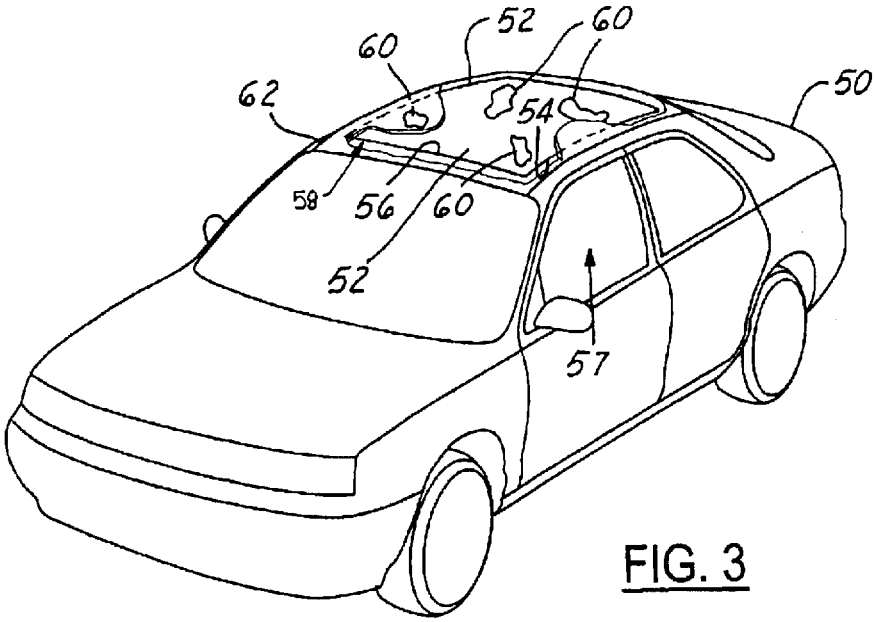
FIG. 3 is a perspective view of an automotive vehicle utilizing an attenuating device in accordance with an embodiment of the present invention.

Referring now to FIG. 3, a perspective view of an automotive vehicle 50 utilizing an attenuating device 52 in accordance with an embodiment of the present invention is shown. For example purposes, the attenuating device 52, as shown, is in the form of a vehicle headliner. The attenuating device 52 is permeable and thus allows air to flow between a first side 54 and a second side 56 of the headliner 52. Air flows from the vehicle interior cabin 57, through the headliner 52, and swirls within gaps 58 and pockets 60 between the headliner 52 and the vehicle roof 62. Air gaps and pockets are common between attenuating devices and vehicle structures, such as the roof 62. The air gaps 58 and pockets 60 may be of various sizes and shapes and may be in various locations. By allowing air to flow through the headliner 52, noise and sounds within the vehicle 50 are significantly attenuated, which will become more apparent in light of the following description.

Figure 4:
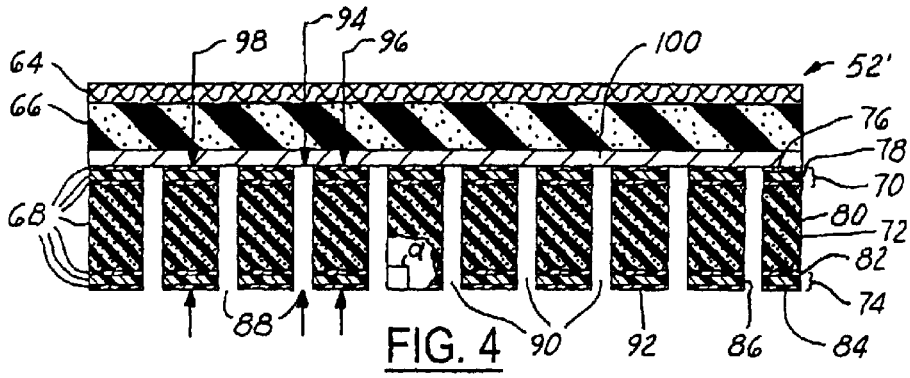
FIG. 4 is a cross-sectional view of an attenuating device having vertical resonating tubes in accordance with an embodiment of the present invention.
Figure 5:
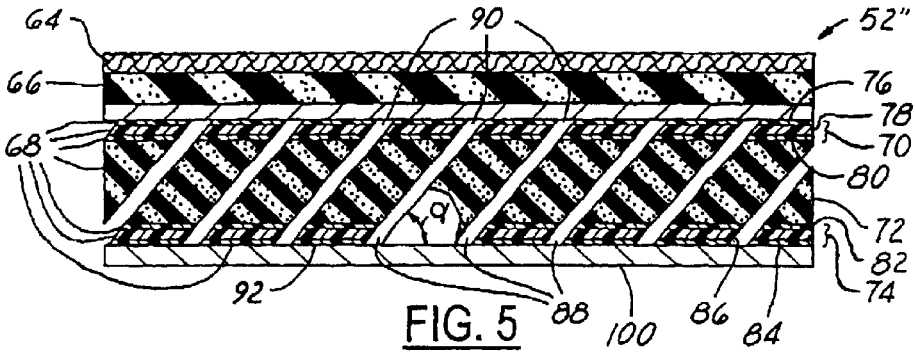
FIG. 5 is a cross-sectional view of an attenuating device having oblique resonating tubes in accordance with another embodiment of the present invention.

Referring now to FIGS. 4 and 5, cross-sectional views of attenuating devices 52' and 52" in accordance with embodiments of the present invention are shown. The attenuating devices 52' and 52" include an exterior surface layer 64, a sound absorption layer 66, and multiple perforated layers 68, which are all permeable and lightweight. The exterior surface layer 64 may be formed of a fabric material and is aesthetically pleasing. The sound absorption layer 66 is coupled between the exterior layer 64 and the multiple perforated layers 68. Although for each attenuating device 52' and 52", a single sound absorption layer 66 and seven perforated layers 68 are shown, various quantities of sound absorption layers and perforated layers may be utilized.

The sound absorption layers 66 may be formed from various types of material including polyester, polyether, and polyurethane and are preferably formed of a relatively soft open-celled foam. The sound absorption layers, although preferably approximately 3–5 mm in thickness, may be of various thickness.

The perforated layers 68 include first structural layers 70, substrate layers 72, and second structural layers 74. The first structural layers 70 are coupled to the sound absorption layer 66. The substrate layers 72 are coupled between the first structural layers 70 and the second structural layers 74.

The first structural layers 70 are preferably thin, approximately 0.5 mm in thickness, and include first film layers 76, first fiberglass layers 78, and second film layers 80. The substrate layers 72 are approximately 5–6 mm in thickness and may be formed of a stiff open-cell foam. Since the substrate layers 72 are perforated they may also be formed of partially closed foam or closed foam, although open cell foam is preferred due to its permeability and sound absorbing and attenuating properties.

The second structural layers 74 include third film layers 82, second fiberglass layers 84, and fourth film layers 86. The second structural layers 74 are slightly thicker than the first structural layers 70, approximately 0.5–0.7 mm in thickness, to provide additional structural support near an upper surface 88 of the attenuating devices 52' and 52". The seven perforated layers 68 provide a relatively stiff structure and assist in maintaining the shapes of the attenuating devices 52' and 52". The above-stated thicknesses are merely examples; layer thicknesses may vary per application.

The film layers 76, 80, 82, and 84 act as adhesive or bonding layers for coupling layers 64, 66, 68, and 100 and may be approximately 30–55 g/sqm. The film layers 76, 80, 82, and 84 may be formed of polyurethane, polyethylene, urethane, or other similar material known in the art.

The fiberglass layers 78 and 86 provide structural rigidity to the attenuating devices 52' and 52" to maintain the shape of the article. The fiberglass layers 78 and 86 may be formed of fiberglass, as shown, thermoplastic, or other similar glass or rigid permeable material known in the art. The fiberglass layers may be in the form of a fiberglass mat or in the form of chopped fiberglass.

The perforated layers 68 define multiple resonating tubes 88 that attenuate sound. Each perforated layer 68 has holes 90, which are in register, that form the resonating tubes 88. The resonating tubes 88 have multiple adjustable parameters including size, quantity, shape, style, pitch, diameter, and perforation pattern. The resonating tubes 88 are tunable by adjusting the resonating tube parameters. Another resonating tube parameter is the perforation angle $\alpha$, which may be varied relative to an exterior structural layer surface 92. Perforation angle $\alpha$, for the attenuation device 52', is approximately 90°. Perforation angle $\alpha$, for the attenuation device 52", is approximately 45°. The two attenuating devices 52' and 52" are similar in structure and strength, but have a significant difference in attenuation performance, due to difference in perforation angle. There is a tradeoff in the amount of attenuation versus strength of the attenuating devices 52' and 52". The more the perforation angle $\alpha$ is decreased below approximately 45° the lower the strength of the attenuating devices 52' and 52". Thus, it is currently believed that a preferred range of angle α is approximately between 45° and 90°.

A lower perforation angle, such as 45°, provides additional one-quarter wavelength absorber effects and also affects the airflow resistivity, which increases the sound absorption. For example, a one-quarter wavelength absorber effect occurs when an air body, such as within the gaps 58 and pockets 60, resonates due to length of the tubes 58 being a quarter wavelength of sound within the cabin 57, thus attenuating the sound. For a region where there is a rigid backing, such as the roof 62, the substrate layer may be formed of closed cell foam to confine the air body and aid in generating one-quarter wavelength absorber effects. The lower the perforation angles the longer the tubes 58, then the lower the frequencies of sound that are absorbed.

The perforations directly affect the airflow resistivity and porosity of the attenuating devices 52' and 52"An open area ratio can be defined as an overall hole surface area divided by total surface area. When increasing the open area ratio, by increasing the size of the holes 90 or the number of the holes 90 for a given surface area, airflow resistivity decreases and the porosity increases. Increase in porosity results in increased attenuation for a decrease in frequency range.

In order to provide adequate resonation and substantial acoustical attenuation, the resonating tubes 88 have a length 94 that is preferably greater than or equal to approximately 3 mm. The Perforated layers combined thickness 96 is directly related to length 94, as sum of perforated layer thicknesses are approximately equal to the length 94. Although, as shown, a majority of the length 94 is contributed by substrate layer thickness 98; the perforated layer thicknesses may be adjusted to alter thickness contributions.

The attenuating devices 52' and 52" may also include one or more filter layers 100 coupled to the perforated layers 68. In one embodiment of the present invention the filter layer 100 can be coupled between the sound absorption layer 66 and the first structural layer 70, as best seen in FIG. 4. In another embodiment of the present invention the filter layer 100 can be coupled to the exterior surface 92. The filter layer 100 may also be used in place of other layers. For example, in an embodiment of the present invention, the filter layer 100 can be used in replacement of the first structural layer 70.

Since the attenuating devices 52' and 52" have multiple perforated layers 68 with resonating tubes 88 of significant length, there exists a potential for contaminates such as dust or dirt to form and spot the exterior layer 64, due to increase airflow through the attenuating devices 52' and 52". Spotting is undesirable due to its aesthetic effects. The filter layer 100 is provided to significantly minimize the potential of spotting or collecting of contaminates on the exterior layer 64. The filter layer 100 filters air between the first side 54 and a second side 56 of the attenuating devices 52' and 52". Air tending to flow from the interior cabin 57 through the attenuating devices 52' and 52", typically contains contaminates, which are absorbed or collected by the filter layer 100.

The filter layer 100 is also relatively thin, approximately 0.2 mm to 1.0 mm in thickness. The filter layer 100 is permeable and may be formed of urethane foam and impregnated with carbon to absorb contaminates. Other filtering materials known in the art may also be used in forming the filter layer 100. The filter layer 100, besides filtering, may be used to adjust the amount of airflow between the first side 54 and the second side 56, by averaging air pressures between the two sides. To adjust airflow through the attenuating devices 52' and 52", the density of the filter layer material may be adjusted.

All of the above-stated layers have various layer parameters that may be modified to satisfy various applications including material thickness, material stiffness, perforation patterns, perforation angles, number of layers, construction of layers, and distribution of layers.

Figure 6:
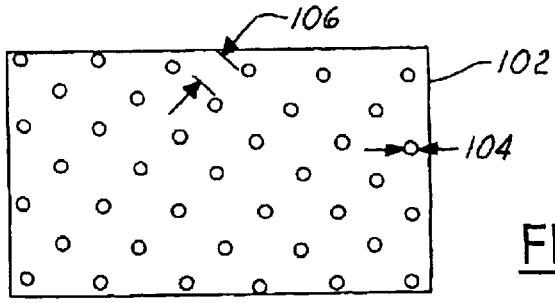
FIG. 6 is a top view of a sample pattern for the perforated layers in accordance with an embodiment of the present invention.

Referring now to FIG. 6, a top view of a sample pattern 102 for the perforated layers 68 in accordance with an embodiment of the present invention is shown. The pattern 102 includes the holes 90, which have a diameter 104 of approximately 0.8 mm and pitch 106 of approximately 4.0 mm (with "pitch" referring to the distance between the holes 90). The diameter 104 is preferably between approximately 0.2 mm and 1.5 mm and the pitch 106 is preferably between approximately 2 mm and 8 mm. Although these dimensions provide the preferred attenuation performance, other diameter and pitch sizes may be used. Also, the holes 90 may form multiple patterns, be of various shape, and may not be uniform in shape.

Figure 7:
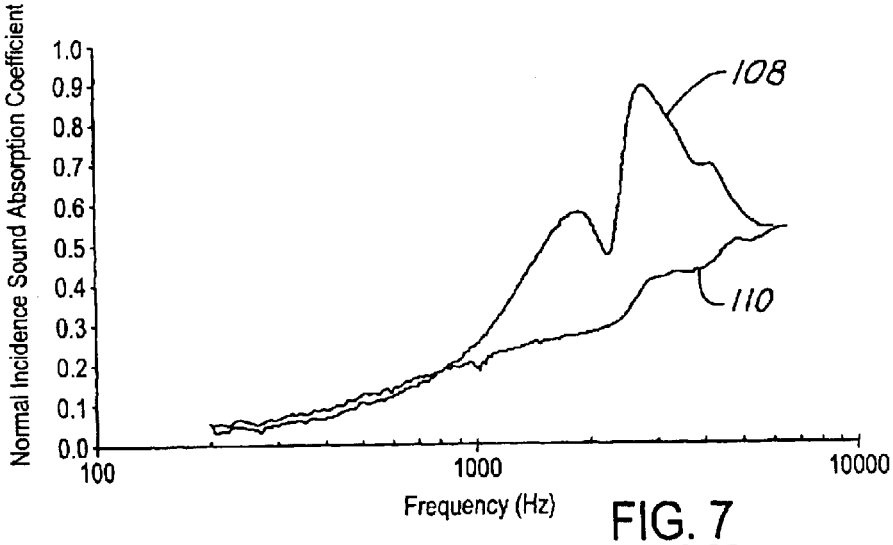
FIG. 7 is a graph comparing sound attenuation for an attenuating device having perforated layers, in accordance with an embodiment of the present invention, and an unperforated attenuating device.

Referring now to FIG. 7, a graph illustrating sound attenuation for an attenuating device having perforated layers in accordance with the present invention, and a similar attenuating device without the structural layers 70 and 74 and the substrate layer 72 being perforated. A first attenuating device having attenuation represented by curve 108 is compared to a second attenuating device having attenuation represented by curve 110. The first attenuating device is formed as the attenuating device 52' and the second attenuating device is formed similar to the attenuating device 52' except without perforations. It is apparent that the attenuating device 52' for frequencies between 1 KHz and 5 KHz provides substantially more attenuation than the attenuating device without perforations. The higher the normal incidence sound absorption coefficient the higher the sound attenuation.

Figure 8:
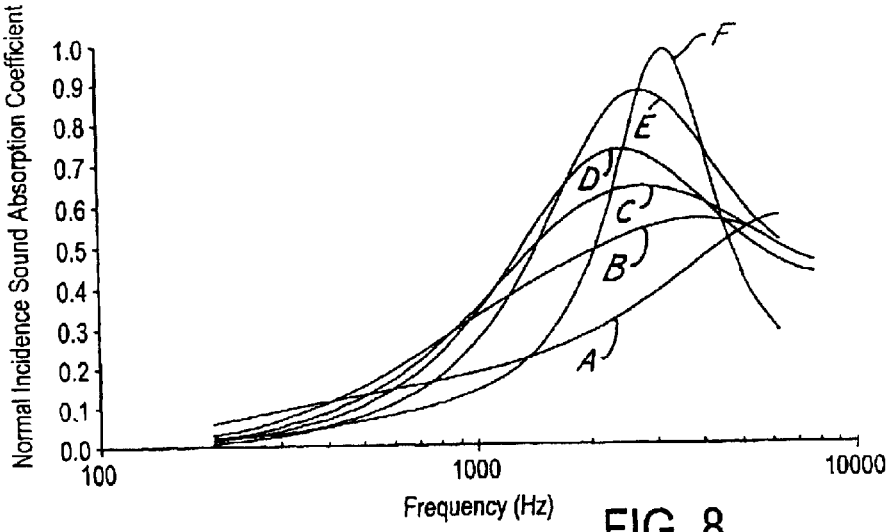
FIG. 8 is a graph illustrating sound attenuation for multiple attenuating devices having varying resonating tube diameters and patterns in accordance with embodiments of the present invention.

FIG. 8 depicts a graph illustrating sound attenuation for multiple attenuating devices having varying resonating tube diameters and patterns in accordance with embodiments of the present invention. Curve A corresponds to an attenuating device that includes the structural layers 70 and 74 and substrate layer 72, none of which have perforations. Curves B-F correspond to the attenuating devices in accordance with the present invention. Curve B corresponds to attenuating device 52' having resonating tube diameters of approximately 0.4 mm and a pitch approximately equal to 4.0 mm. Curve C corresponds to attenuating device 52' having resonating tube diameters of 0.5 mm and a pitch approximately equal to 4.0 mm. Curve D corresponds to attenuating device 52' having resonating tube diameters of 0.6 mm and a pitch approximately equal to 4.0 mm. Curve E corresponds to attenuating device 52' having resonating tube diameters of approximately 0.8 mm and pitch values of approximately 4.0 mm. Curve F corresponds to attenuating device 52' having resonating tube diameters of 2.4 mm and a pitch approximately equal to 8.0 mm.

Reviewing curves A-E, as the diameter of the resonating tubes increases, in general, the sound attenuation increases, particularly within the desired frequency range of 1 KHz and 5 KHz. Also, as the pitch increases, the frequency attenuation range decreases. For example, it can be said that curve E has a significant attenuation range between 1 KHz and 5 KHz, whereas curve F has a significant attenuation range between 2 KHz and 4.75 KHz.

Figure 9:
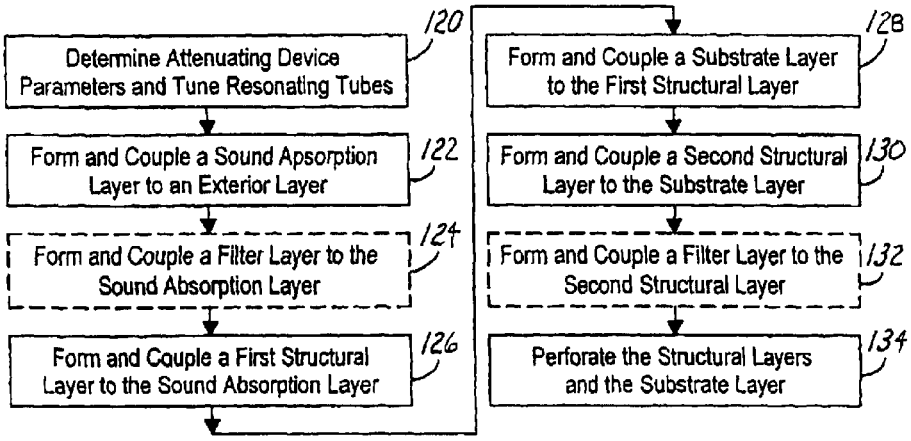
FIG. 9 is a logic flow diagram illustrating a method of manufacturing acoustical attenuation devices in accordance with embodiments of the present invention.

Referring now to FIG. 9, a logic flow diagram illustrating a method of manufacturing the attenuation devices 52' and 52" in accordance with an embodiment of the present invention is shown.

In step 120, attenuating device parameters are determined and resonating tubes are tuned, to achieve desirable absorption performance, by determining and adjusting one or more of the following parameters: material thicknesses, air flow resistivity, material stiffnesses, number of layers, resonating tube diameters, resonating tube pitches, construction of layers, distribution of layers, perforation patterns, perforation angles, density of layers, porosity, tortuosity, Young's modulus, Poisson's ratio, dampening, and viscous shape factor.

Some generalizations of the above parameters may be simply stated and are expressed below, while others are frequency dependent and non-linear. Thicker absorption material and thicker perforated layers 68 provides increased low frequency absorption. Porosity is referred to as ratio of air volume within an object relative to total volume of the object. By increasing porosity, the frequency range of absorption is increased. Tortuosity is dependent upon angles between pores in an object and the macroscopic direction of sound propagation through that object, and is sometimes referred to as a structural form factor. The viscous shape factor depends on the cross-sectional shape of pores within an object. The effects of tortuosity and viscous shape factor, as well as other parameters, on acoustical performance, are frequency dependent and non-linear in nature.

In step 122, the sound absorption layer 66 is formed and coupled to an exterior layer 64. In step 124, a filter layer 100 may be formed and coupled to the sound absorption layer 66. In step 126, the first structural layer 70 is formed and coupled to the sound absorption layer 66 or to the filter layer 100, via the first film layer 76. In step 128, the substrate layer 72 is formed and coupled to the first structural layer 70, via the second film layer 80.

In step 130, the second structural layer 74 is formed and coupled to the substrate layer 72, via the third film layer 82. In step 132, a filter layer 100 may be formed and coupled to the second structural layer 74, via the fourth film layer 84.

In step 134, the structural layers 70 and 74 and the substrate layer 72 are perforated by laser drilling or by punching holes through the layers 70, 72, and 74 to form the resonating tubes 88. Perforation after assembling the attenuation devices 52' and 52" assures that the holes 90 are in register. Of course, other known techniques may be used to form the resonating tubes 88. The holes 90 may be formed before or after assembly of the attenuation devices 52' and 52"

The above-described steps are meant to be an illustrative example and the steps may be performed sequentially, synchronously, or in a different order depending upon the application. Also the layers 64, 66, 68, and 100 may be formed during assembly of the attenuation devices 52' and 52", separately, or in some other format as known in the art.

The present invention provides an attenuation device with increased permeability and that allows for increased airflow through the device, thus providing improved acoustical attenuation. The present invention is versatile in being tunable to attenuate various desired frequency ranges at various attenuation levels. The present invention is also capable of absorbing contaminates flowing into the attenuation device, as to maintain a desirable esthetic appearance.

The above-described apparatus, to one skilled in the art, is capable of being adapted for various purposes and is not limited to the following systems: ground-based vehicles, aeronautical vehicles, watercraft, headliners, vehicle panels, or other applications that may utilize an acoustical attenuation device. The above-described invention may also be varied without deviating from the spirit and scope of the invention as contemplated by the following claims.

What is claimed is:

1. An acoustical attenuating device comprising:

an exterior layer;

at least one sound absorption layer coupled to said exterior layer; and a plurality of perforated layers coupled to said at least one sound absorption layer and comprising:

at least one perforated structural layer; and at least one perforated substrate layer directly coupled to said at least one perforated structural layer;

said at least one perforated structural layer and said at least one perforated substrate layer providing structural stiffness and in combination defining a plurality of resonating tubes that attenuate sound.

2. A device as in claim 1 wherein perforations in said at least one perforated structural layer and in said at least one perforated substrate layer are in register.

3. A device as in claim 1 wherein said at least one perforated structural layer comprises:

a first perforated film layer;

a perforated fiberglass layer coupled to said first perforated film layer; and a second perforated film layer coupled to said perforated fiberglass layer.

4. A device as in claim 1 wherein said plurality of perforated layers comprise:

a first perforated structural layer coupled to said sound absorption layer;

a perforated substrate layer coupled to said first perforated structural layer; and a second perforated structural layer coupled to said perforated substrate layer.

5. A device as in claim 1 wherein said at least one sound absorption layer is permeable.

6. A device as in claim 1 further comprising at least one filter layer coupled to said plurality of perforated layers and for filtering air between a first side and a second side of the acoustical attenuating device.

7. A device as in claim 6 wherein said at least one filter layer is coupled between said at least one sound absorption layer and said plurality of perforated layers.

8. A device as in claim 6 wherein said at least one filter layer is formed of urethane foam impregnated with carbon.

9. A device as in claim 6 wherein said at least one filter layer is permeable.

10. A device as in claim 1 wherein said plurality of resonating tubes are at least approximately 3 mm in length.

11. A device as in claim 1 wherein said at least one perforated structural layer is formed of a material selected from at least one of fiberglass, polyurethane, thermoplastic, and polyethylene.

12. A device as in claim 1 wherein said at least one sound absorption layer is formed of open cell foam.

13. A device as in claim 1 wherein said acoustical attenuating device is in a form of a vehicle headliner.

14. A device as in claim 1 wherein said resonating tubes form at least one attenuating pattern.

15. A method of forming an acoustical attenuating device comprising:

forming and coupling at least one sound absorption layer to an exterior layer; and forming and coupling at least one structural layer to said at least one sound absorption layer;

forming and coupling at least one substrate layer to said at least one structural layer;

defining a plurality of resonating tubes in formation and coupling of said at least one substrate layer to said at least one structural layer; and perforating said at least one structural layer and said at least one substrate layer after coupling thereof.

16. A method as in claim 15 further comprising determining an acoustical attenuating device parameter selected from at least one of material thickness, air flow resistivity, material stiffness, number of layers, resonating tube diameter, resonating tube pitch, construction of layers, distribution of layers, perforation pattern, perforation angle, density of layers, porosity, tortuosity, Young's modulus, Poisson's ratio, dampening, and viscous shape factor.

17. A vehicle headliner formed according to method of claim 15.

18. An acoustical attenuating device comprising:

an exterior layer;

at least one sound absorption layer coupled to said exterior layer;

a plurality of perforated layers coupled to said at least one sound absorption layer and comprising:

at least one perforated structural layer; and at least one perforated substrate layer directly coupled to said at least one perforated structural layer;

said at least one perforated structural layer and said at least one perforated substrate layer providing structural stiffness and in combination defining a plurality of resonating tubes that attenuate sound; and at least one filter layer coupled to said plurality of perforated layers and filtering air between a first side and a second side of the acoustical attenuating device;

said exterior layer, said at least one sound absorption layer, and said plurality of perforated layers are permeable.

19. A device as in claim 18 wherein said at least one perforated structural layer comprises:

a first perforated film layer;

a perforated fiberglass layer coupled to said first perforated film layer; and a second perforated film layer coupled to said perforated fiberglass layer.

20. A device as in claim 18 wherein said plurality of perforated layers comprise:

a first perforated structural layer coupled to said sound absorption layer;

a perforated substrate layer coupled to said first perforated structural layer; and a second perforated structural layer coupled to said perforated substrate layer.

* * * * *